US007983585B2

(12) United States Patent
Miyahara

(10) Patent No.: US 7,983,585 B2
(45) Date of Patent: Jul. 19, 2011

(54) PRINTING APPARATUS AND PRINTING METHOD

(75) Inventor: Norifumi Miyahara, Osaka (JP)

(73) Assignee: Kyocera Mita Corporation (JP)

( * ) Notice: Subject to any disclaimer, the term of this patent is extended or adjusted under 35 U.S.C. 154(b) by 96 days.

(21) Appl. No.: 12/604,926

(22) Filed: Oct. 23, 2009

(65) Prior Publication Data

US 2010/0189458 A1 Jul. 29, 2010

(30) Foreign Application Priority Data

Jan. 29, 2009 (JP) ..... 2009-018683

(51) Int. Cl.
*G03G 15/00* (2006.01)

(52) U.S. Cl. ..... 399/82; 399/401; 399/402

(58) Field of Classification Search ..... 399/82, 399/401, 402
See application file for complete search history.

(56) References Cited

U.S. PATENT DOCUMENTS 4,908,660 A * 3/1990 Ohira et al. ..... 399/402 X
5,331,386 A * 7/1994 Mizubata et al. ..... 399/82
5,703,693 A * 12/1997 Morikawa ..... 358/296
5,839,044 A * 11/1998 Taruki ..... 399/401 X
5,987,300 A * 11/1999 Mori ..... 399/401
6,741,819 B2 * 5/2004 Han ..... 399/82
6,763,219 B2 * 7/2004 Kobayashi et al. ..... 399/401
6,895,197 B2 * 5/2005 Shibata ..... 399/82
7,289,239 B2 * 10/2007 Kadowaki ..... 399/82 X
7,607,658 B2 * 10/2009 Fujiwara ..... 399/401 X

FOREIGN PATENT DOCUMENTS

JP 2002-337417 11/2002
JP 2003-205652 7/2003

* cited by examiner

*Primary Examiner* — Sandra L Brase
(74) *Attorney, Agent, or Firm* — McDonnell Boehnen Hulbert & Berghoff LLP

(57) ABSTRACT

A printing apparatus includes a printing control unit that performs, between printing on a first printing side of a paper sheet and printing on a second printing side thereof, to print on the first printing side of a next paper sheet; a determination unit that determines, when the printing on the first printing side of the paper sheet is finished, whether a process of processing print data for the next paper sheet has been completed; and a standby control unit that causes a printing unit to delay a printing process on the second printing side of the paper sheet until printing on the first printing side of the next paper sheet is finished if it is determined that the process of processing the print data for the next paper sheet has not been completed.

20 Claims, 6 Drawing Sheets

(A) PROCESS OF PRINTING THREE COPIES OF FIVE-PAGE DOCUMENT (B) HIGH-SPEED PROCESS OF PRINTING THREE COPIES OF THREE-PAGE DOCUMENT (C) HIGH-SPEED PROCESS OF PRINTING THREE COPIES OF FIVE-PAGE DOCUMENT (D) HIGH-SPEED PROCESS OF PRINTING THREE COPIES OF SEVEN-PAGE DOCUMENT

CONVENTIONAL CONTROL IN PRINTING PROCESS FOR ONE COPY OF TWELVE-PAGE DOCUMENT

PRINT SIXTH PAGE AFTER THIRD PAGE
BECAUSE DATA FOR EIGHTH PAGE IS NOT PROVIDED IN TIME

CONTROL IN PRINTING PROCESS FOR ONE COPY OF TWELVE-PAGE DOCUMENT ACCORDING TO THE PRESENT INVENTION

WHEN DATA FOR EIGHTH PAGE IS NOT PROVIDED IN TIME, WITHOUT ADVANCING FROM THIRD PAGE TO SIXTH PAGE, AFTER FINISHING PRINTING THIRD PAGE, STANDBY STATE IS MAINTAINED UNTIL DATA FOR EIGHTH PAGE IS GENERATED AND PRINTED, AND THEN DATA FOR SIXTH PAGE IS PRINTED

PRINTING APPARATUS AND PRINTING METHOD

INCORPORATION BY REFERENCE

This application is based upon and claims the benefit of priority from corresponding Japanese Patent Application No. 2009-018683, filed Jan. 29, 2009, the entire contents of which are incorporated herein by reference.

BACKGROUND

1. Field of the Invention

The present invention relates to a printing apparatus that performs a high-speed double-sided printing process.

2. Description of the Related Art

Examples of a method of performing double-sided printing of a plurality of pages on a printing apparatus capable of double-sided printing include a method (2-page type sequence, normal double-sided printing control) of printing respective pages in an order of back side/front side for each paper sheet, for example, in order of Page2→Page1→Page4→Page3. Another example thereof is a method (4-page type sequence, high-speed double-sided printing control) of printing in an order of, for example, Page2→Page4→Page1→Page3, by printing on one side (back side in the above-mentioned example) of a first paper sheet, supplying a next paper sheet to perform printing on the same-side (back side in the above-mentioned example) thereof while reversing the first paper sheet, and then printing on the unprinted front side of the reversed paper sheet having the one side thereof already printed. In this method, during a time taken to reverse the paper sheet, the next paper sheet is subjected to an operation of single-sided printing, thereby making it possible to increase a printing speed.

In performing the above-mentioned high-speed double-sided printing control, if there is a request for double-sided printing upon completion of printing on a first printing side, a high-speed double-sided printing process is executed (in a case where a condition for carrying out high-speed double-sided printing is satisfied). However, if there is no request for double-sided printing, a printing process is performed on a second printing side corresponding to a page subsequent to a page for which printing has been completed, thereby finishing the double-sided printing. In this case, even if the request for double-sided printing is received immediately after the printing process on the second printing side, the high-speed double-sided printing control may not be carried out, resulting in a delay of the process.

SUMMARY

A printing apparatus according to one aspect of the present invention includes: a job receiving unit that receives a printing job; a printing unit that performs printing on a paper sheet based on the printing job; a reversing mechanism unit that reverses the paper sheet for which printing on a first printing side has been finished by the printing unit and transports the paper sheet again to the printing unit in order for printing to be performed on a second printing side thereof; a printing control unit that executes double-sided printing control of the printing job received by the job receiving unit by performing, between printing on the first printing side of the paper sheet and printing on the second printing side thereof, printing on the first printing side of a next paper sheet; a determination unit that determines, when the printing on the first printing side of the paper sheet is finished, whether or not there is a request to print the next paper sheet and a process of generating print data for the next paper sheet in accordance with the request has been completed; and a standby control unit that causes the printing unit to delay a printing process on the second printing side of the paper sheet until printing on the first printing side of the next paper sheet is finished if it is determined by the determination unit that the process of generating the print data for the next paper sheet has not been completed.

A printing apparatus according to another aspect of the present invention includes: a job receiving unit that receives a printing job; a printing unit that performs printing on a paper sheet based on the printing job; a reversing mechanism unit that reverses the paper sheet for which printing on a first printing side has been finished by the printing unit and transports the paper sheet again to the printing unit in order for printing to be performed on a second printing side thereof; a printing control unit that executes double-sided printing control of the printing job received by the job receiving unit by performing, between printing on the first printing side of the paper sheet and printing on the second printing side thereof, printing on the first printing side of a next paper sheet; a determination unit that determines, when printing on the second printing side of a paper sheet preceding the paper sheet is finished after the printing on the first printing side of the paper sheet, whether or not there is a request to print the next paper sheet and a process of generating print data for the next paper sheet in accordance with the request has been completed; and a standby control unit that causes the printing unit to delay a printing process on the second printing side of the paper sheet until printing on the first printing side of the next paper sheet is finished if it is determined by the determination unit that the process of generating the print data for the next paper sheet has not been completed.

A printing method for a print controller on a printing apparatus according to a further aspect of the present invention includes:

the print controller causing the printing apparatus to receive a printing job;

the print controller causing the printing apparatus to print on a paper sheet based on the printing job;

the print controller causing the printing apparatus to reverse the paper sheet for which printing on a first printing side has been finished and transport the paper sheet to a print unit in order for printing to be performed on a second printing side thereof;

the print controller causing the printing apparatus to execute double-sided printing control of the printing job by performing, between the printing for the first printing side of the paper sheet and the printing for the second printing side thereof, the printing for the first printing side of a next paper sheet;

the print controller causing the printing apparatus to determine, when the printing for the first printing side of the paper sheet is finished or when the printing for the second printing side of a paper sheet preceding the paper sheet is finished, whether or not there is a request to print the next paper sheet and a process of generating print data for the next paper sheet in accordance with the request has been completed; and the print controller causing the printing apparatus to delay execution of the printing for the second printing side of the paper sheet until the printing for the first printing side of the next paper sheet is finished if it is determined that the process has not been completed.

Additional features and advantages are described herein, and will be apparent from the following Detailed Description and the figures.

DETAILED DESCRIPTION

Figure 1:
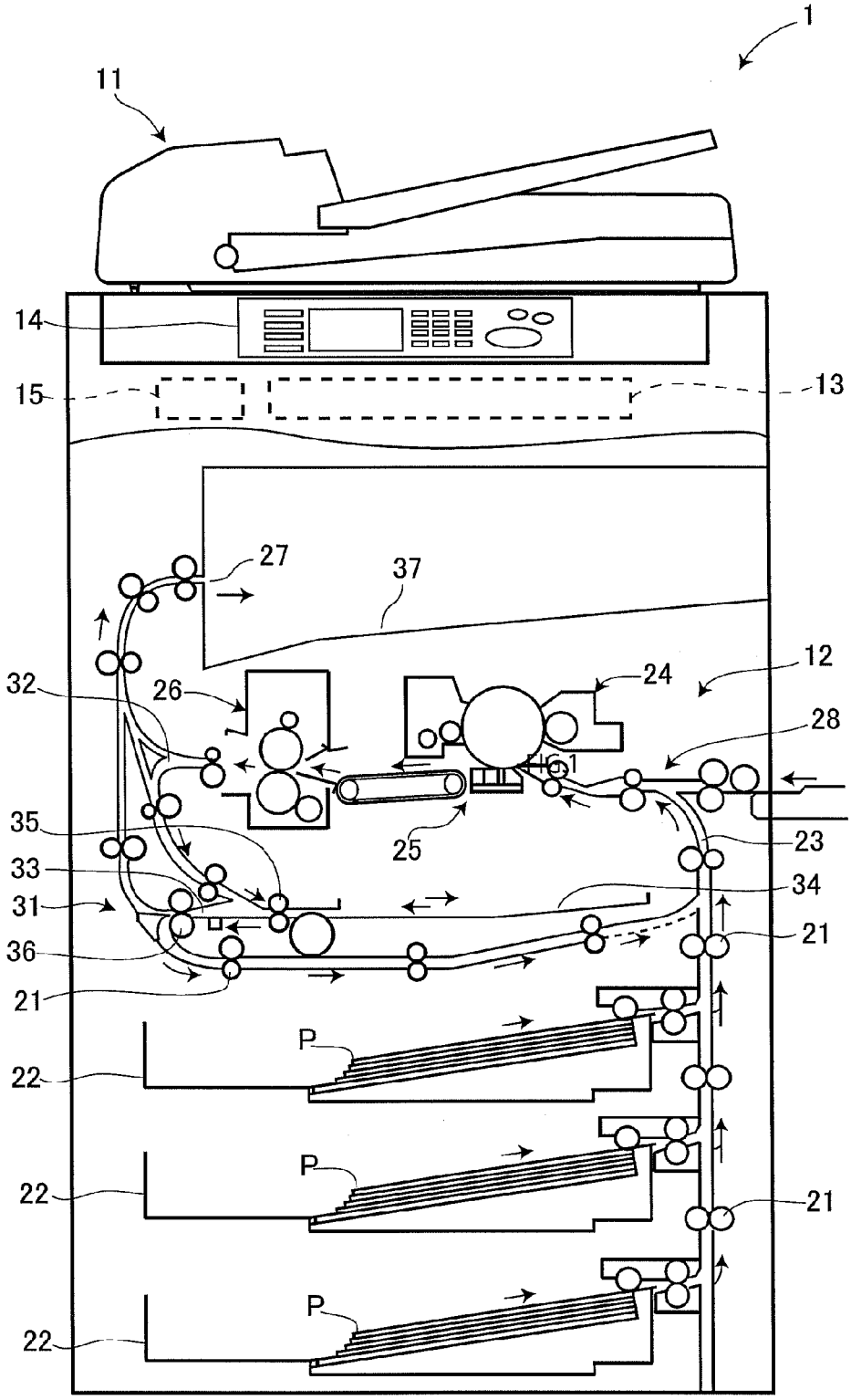
FIG. 1 is a front view illustrating an internal structure of a printing apparatus according to an embodiment of the present invention.

FIG. 1 illustrates a printing apparatus according to an embodiment of the present invention. A printing apparatus 1 is, for example, a multifunction peripheral (MFP) having a copy function and a printing function. The printing apparatus 1 includes a document reading mechanism 11, a printing unit 12, a control unit 13, an operation unit 14, and a communication interface 15.

The document reading mechanism 11 is a mechanism for reading a document, and is provided at an upper portion of the printing apparatus 1.

The printing unit 12 is a unit for printing with respect to one or both of a front side and a back side of a paper sheet P. The printing unit 12 is provided at an internal portion of the printing apparatus 1. The printing unit 12 prints an image of the document read by the document reading mechanism 11 or an image transmitted from a personal computer or the like which is communicably connected to the printing apparatus 1 onto the paper sheet P.

The control unit 13 is a unit for controlling the document reading mechanism 11, the printing unit 12, and the like. The control unit 13 includes a job receiving unit, a printing control unit, a determination unit, and a standby control unit. The control unit 13 is a specific example of a print controller. The control unit 13 is provided at an internal portion of the printing apparatus 1.

The operation unit 14 is provided at a front panel of the printing apparatus 1, and includes buttons, a display, and the like that may be used by a user to operate the printing apparatus 1.

The communication interface 15 is provided at an internal portion of the printing apparatus 1, and includes a communication circuit for communicably connecting the printing apparatus 1 to a terminal device.

The printing unit 12 includes a paper sheet transport mechanism 28 for: rotating a transport roller 21 to transport each of paper sheet P accommodated in sheet feeding cassettes 22 along a paper sheet transport path 23; sequentially supplying each paper sheet P to a print engine 24, a transferring section 25, and a fixing section 26; and delivering each paper sheet P for which a printing process has been completed from a delivery section 27 to a delivery tray 37.

Figure 3:
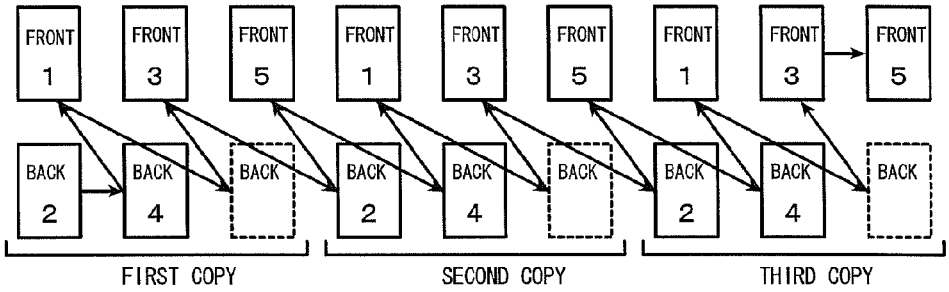
FIGS. 3A to 3D are explanatory diagrams for procedures followed when performing double-sided printing of a plurality of copies each having an odd number of pages on the printing apparatus according to an embodiment of the present invention.
Figure 3:
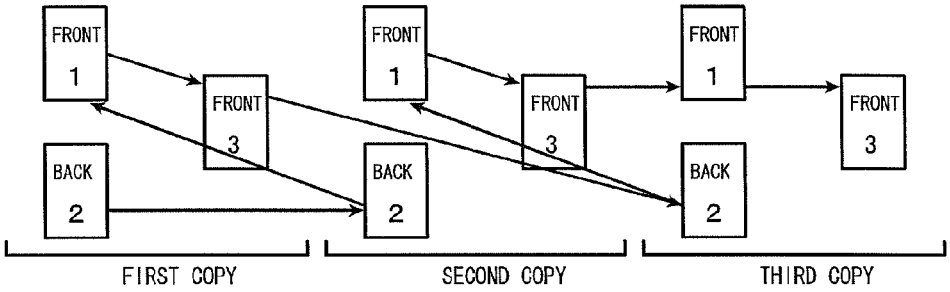
Figure 3:
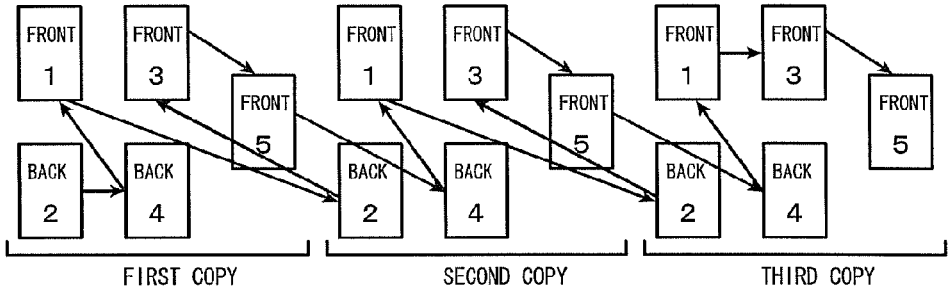
Figure 3:
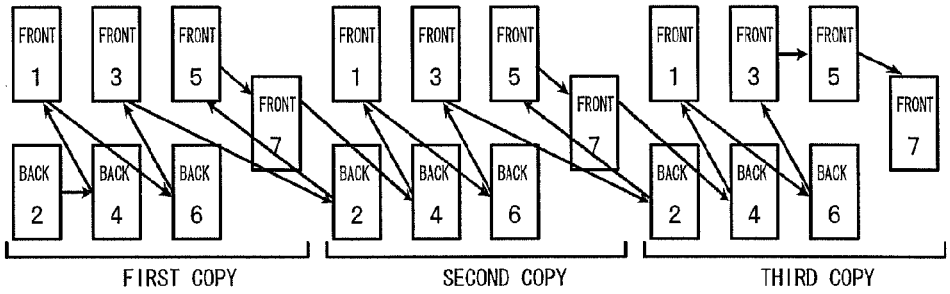

The paper sheet transport mechanism 28 includes a double-sided printing unit (reversing mechanism unit) 31 for performing double-sided printing. The double-sided printing unit 31 is structured so as to realize high-speed double-sided printing for performing double-sided printing with respect to three paper sheets P in parallel (see FIG. 3). The double-sided printing unit 31 includes a branch section 32, a paper sheet transport path 33, an intermediate tray 34, a switchback mechanism 35, and a paper sheet reversing device 36. The branch section 32 is disposed between a paper sheet delivery side of the fixing section 26 and the delivery section 27, and may send the paper sheet P to the paper sheet transport path 33 of the double-sided printing unit 31. The intermediate tray 34 is disposed adjacent the paper sheet transport path 33, and temporarily stores one paper sheet P sent by the branch section 32. The switchback mechanism 35 reverses a transport direction of the paper sheet P kept in store on the intermediate tray 34, and sends the paper sheet P to the paper sheet transport path 33. The paper sheet reversing device 36 uses the switchback mechanism 35 to thereby reverse sides of the paper sheet P sent again to the paper sheet transport path 33, and supplies the paper sheet P back to the print engine 24.

The double-sided printing unit 31 keeps in store therein the paper sheet P for which printing on a first printing side thereof has been completed. The double-sided printing unit 31 may cause the paper sheet P to delay until data processing of print data for the first printing side of the next paper sheet is completed and sent to the printing unit 12 to complete the printing. This control prevents high-speed double-sided printing control from being aborted due to a delay in data processing.

Figure 2:
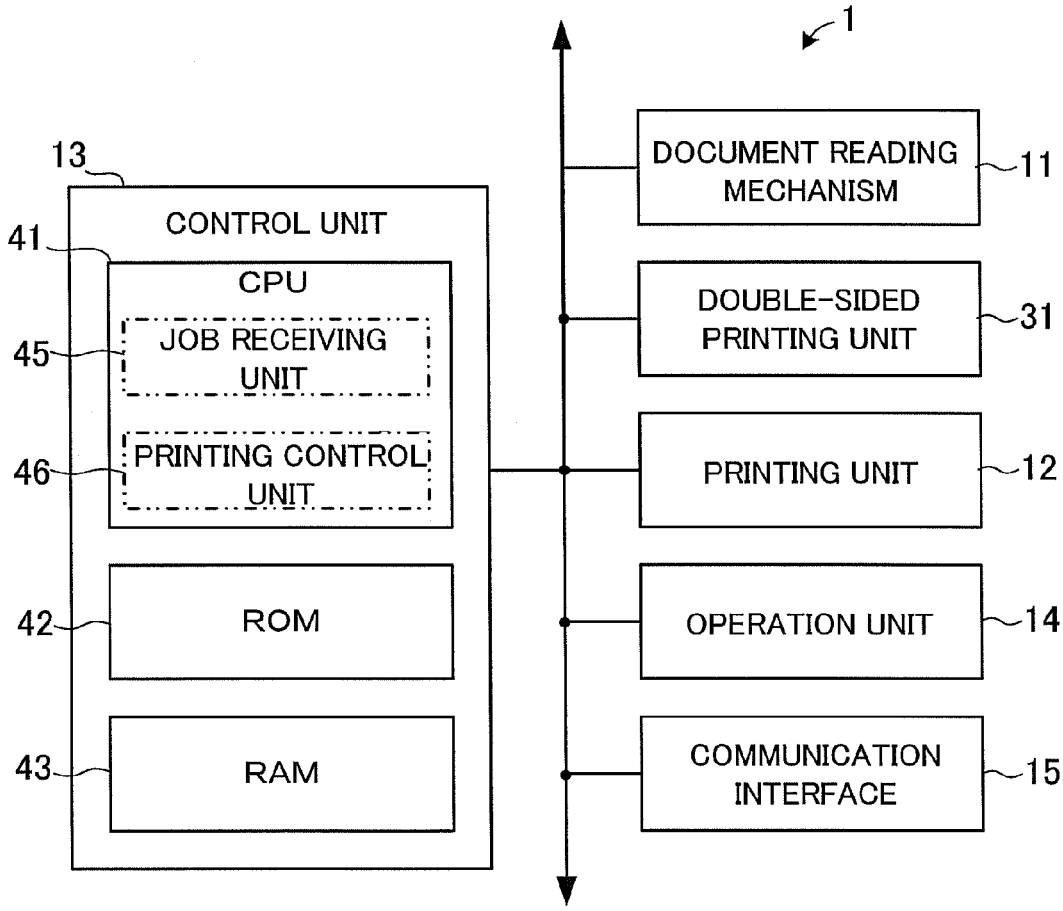
FIG. 2 is a functional block diagram of the printing apparatus according to an embodiment of the present invention.

FIG. 2 illustrates an internal configuration of the control unit 13. The control unit 13 includes a central processing unit (CPU) 41, a read only memory (ROM) 42, and a random access memory (RAM) 43. The ROM 42 stores a computer program for causing the control unit 13 to function as a job receiving unit 45, a printing control unit 46, and the like. The CPU 41 reads the computer program from the ROM 42, and executes the computer program to cause the control unit 13 to function as the job receiving unit 45, the printing control unit 46, and the like. The RAM 43 is used as a work memory or the like by the CPU 41 executing the computer program.

The job receiving unit 45 receives a single-sided printing job or a double-sided printing job that has been input by the user through an operation of the operation unit 14 or that has been transmitted from a terminal device, and stores the received job into the RAM 43. The single-sided printing job is a job giving an instruction to perform printing with respect to only a front side of a paper sheet P. The double-sided printing job is a job giving an instruction to perform printing with respect to both a front side and a back side of a paper sheet P. The printing control unit 46 controls the printing unit 12 and the double-sided printing unit 31 according to the job received by the job receiving unit 45. According to the type of job received by the job receiving unit 45, the printing control unit 46 selects one control method from printing control methods such as single-sided printing control, normal double-sided printing control, high-speed double-sided printing control, and the like, and executes the selected printing control. The normal double-sided printing control is a printing method of printing on the first printing side of one paper sheet, then printing on a second printing side of the one paper sheet, and then printing on another paper sheet. The high-speed double-sided printing control is a printing method of performing, between printing the first printing side of one paper sheet and printing the second printing side of a first paper sheet, printing the first printing side or the second printing side of a second paper sheet, thereby performing double-sided printing with respect to two or more paper sheets in parallel.

While performing the high-speed double-sided printing control, between double-sided printing the first printing side and double-sided printing the second printing side, the printing control unit 46 performs printing on the first printing side of subsequent double-sided printing. In the conventional technology, if the print data for the subsequent double-sided printing cannot be generated in time, the printing on the second printing side of the paper sheet is performed without performing the subsequent double-sided printing. When there is single-sided printing or double-sided printing for the next paper sheet after the printing has been performed on the first printing side of the paper sheet of the double-sided printing, the printing control unit 46 of the printing apparatus 1 according to the embodiment of the present invention waits until the print data for the next paper sheet is generated, and then performs printing thereof. After that, a printing process on the second printing side of the double-sided printing is started.

The print data may be image data obtained by converting an image into a bitmap format in order for the printing unit 12 to execute printing thereof.

Details of the job receiving unit 45 and the printing control unit 46 are described next by using FIGS. 3A to 3D, FIG. 4 and FIG. 5.

FIGS. 3A to 3D are diagrams illustrating a printing order of a high-speed double-sided printing processes (A) (high-speed double-sided printing in which a dummy page is added as the second page), (B), (C), and (D) (high-speed double-sided printings in which a dummy page is not added as the second page, which are higher in process speed). FIG. 3A illustrates a process of printing control executed by the printing control unit 46 when the job receiving unit 45 receives a job of printing three copies of a five-page document.

(1) Printing on the back side of a first paper sheet of a first copy (that is, printing of a second page) is performed. While the first paper sheet is being sent to the reversing mechanism unit 31 and reversed, (2) printing on the back side of a second paper sheet of the first copy (that is, printing of a fourth page) is performed. While the second paper sheet is being sent to the reversing mechanism unit 31 and reversed, (3) printing on the front side of the first paper sheet sent again from the reversing mechanism unit 31 to the printing unit 12 (that is, printing of a first page) is performed. While the first paper sheet is being delivered to the delivery tray 37, (4) printing on the back side of a third paper sheet of the first copy (that is, printing of a blank page) is performed by the printing unit 12 assuming that there is a blank dummy page. While the third paper sheet is being sent to the reversing mechanism unit 31 and reversed, (5) printing on the front side of the second paper sheet of the first copy (that is, printing of a third page) is performed. While the second paper sheet is being delivered to the delivery tray 37, (6) printing on the back side of a first paper sheet of a second copy (that is, printing of a second page) is performed. While the first paper sheet is being sent to the reversing mechanism unit 31 and reversed, (7) printing on the front side of the third paper sheet of the first copy (that is, printing of a fifth page) is performed. While the third paper sheet is being delivered to the delivery tray 37, (8) printing on the back side of a second paper sheet of the second copy (that is, printing of a fourth page) is performed. After that, the operation is repeated in the same manner.

FIG. 3A is used to describe the case of five pages, but the printing control is also performed for printing of another odd number of pages by adding a dummy page as the second page in the same manner.

FIG. 3B illustrates a process order of printing control executed by the printing control unit 46 when the job receiving unit 45 receives a job of printing three copies of a three-page document.

(1) Printing on the back side of a first paper sheet of a first copy (that is, printing of a second page) is performed. While the first paper sheet is being sent to the reversing mechanism unit 31 and reversed, (2) printing on the back side of a first paper sheet of a second copy (that is, printing of a second page) is performed. While the first paper sheet of the second copy is being sent to the reversing mechanism unit 31 and reversed, (3) printing on the front side of the first paper sheet of the first copy passed again from the reversing mechanism unit 31 to the printing unit 12 (that is, printing of a first page) is performed. While the first paper sheet of the first copy is being delivered to the delivery tray 37, (4) printing on the front side of a second paper sheet of the first copy (that is, printing of a third page) is performed. The front side of the second paper sheet corresponds to the second page with no page to be printed on its opposite side, and is hence delivered to the delivery tray 37 without being sent to the reversing mechanism unit 31. (5) Printing on the back side of a first paper sheet of a third copy (that is, printing of a second page) is performed. After that, the operation is repeated in the same manner.

The second paper sheet corresponding to the second page is delivered without being passed to the reversing mechanism unit 31 after the printing is performed on the front side thereof. As a result, it becomes possible to start the printing on the back side of the first paper sheet of the subsequent third copy earlier, which accelerates an overall printing speed.

FIG. 3C illustrates a process order of printing control executed by the printing control unit 46 when the job receiving unit 45 receives a job of printing three copies of a five-page document.

(1) Printing on the back side of a first paper sheet of a first copy (that is, printing of a second page) is performed. While the first paper sheet is being sent to the reversing mechanism unit 31 and reversed, (2) printing on the back side of a second paper sheet of the first copy (that is, printing of a fourth page) is performed. While the second paper sheet is being sent to the reversing mechanism unit 31 and reversed, (3) printing on the front side of the first paper sheet sent from the reversing mechanism unit 31 back to the printing unit 12 (that is, printing of a first page) is performed. While the first paper sheet of the first copy is being delivered to the delivery tray 37, (4) printing on the back side of a first paper sheet of a second copy (that is, printing of a second page) is performed. While the first paper sheet of the second copy is being sent to the reversing mechanism unit 31 and reversed, (5) printing on the front side of the second paper sheet of the first copy, which is sent from the reversing mechanism unit 31 back to the printing unit 12 (that is, printing of a third page), is performed. While the second paper sheet of the first copy is being delivered to the delivery tray 37, (6) printing on the front side of a third paper sheet of the first copy (that is, printing of a fifth page) is performed. The front side of the third paper sheet corresponds to the second page with no page to be printed on its opposite side, and is hence delivered to the delivery tray 37 without being sent to the reversing mechanism unit 31. While the third paper sheet is being delivered to the delivery tray 37, (7) printing on the back side of a second paper sheet of the second copy (that is, printing of a fourth page) is performed. After that, the operation is repeated in the same manner.

The third paper sheet corresponding to the second page is delivered without being passed to the reversing mechanism unit 31 after the printing is performed on the front side thereof. As a result, it becomes possible to start the printing on the back side of the second paper sheet of the subsequent copy earlier. In addition, the back side of the second page does not pass through the printing unit 12, which accelerates the overall printing speed.

FIG. 3D illustrates a process order of printing control executed by the printing control unit 46 when the job receiving unit 45 receives a job of printing three copies of a seven-page document.

This printing is performed in the process order in which two pages of a second paper sheet are added before the first paper sheet is ejected in the case of printing three copies of the five-page document. A detailed procedure therefor, which can be understood from FIG. 3D, is omitted.

Figure 4:
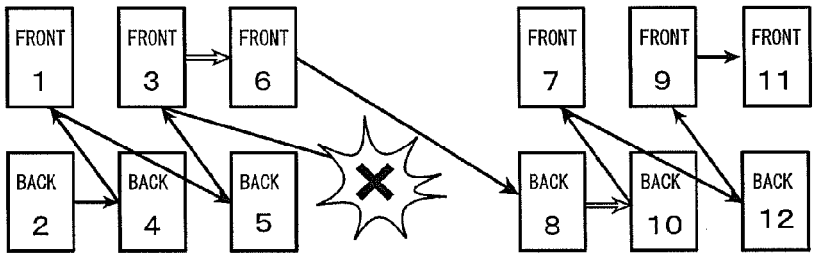
FIG. 4 illustrates a printing sequence for a conventional printing apparatus.

FIG. 4 illustrates a printing sequence used to describe an example in which the high-speed double-sided printing control is aborted.

FIG. 4 illustrates the printing sequence for a case of printing one copy of a twelve-page document. Here, it is assumed that, for example, it takes a large amount of time to process data of a complicated image for page 8. The printing sequence advances printing as described above in order of pages 2, 4, 1, 5, and 3. At this time, it takes so much time to process the data for page 8 that image data (bitmap data, for example) has not yet been generated. Therefore, the image data for page 8 cannot be sent to the print engine 24, and a printing process instruction for page 8 cannot be issued. Then, the paper sheet on which the printing of the back side page 5 has been finished is returned via the reversing mechanism unit 31, and hence page 6 is completed printing. After that, the high-speed double-sided printing control is started again from page 8 for which the data processing has since been completed and the bitmap data generated, and the printing is advanced in order of pages 8, 10, 7, 12, 9, and 11. In this printing process, a switch is made from the high-speed double-sided printing control to the normal double-sided printing control. As a result, a large amount of time is required for an entire printing process.

Figure 5:
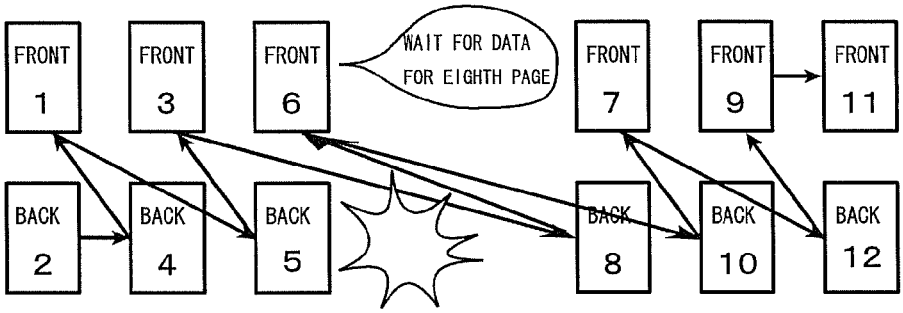
FIG. 5 illustrates a printing sequence for the printing apparatus according to an embodiment of the present invention.

Next, FIG. 5 illustrates a printing sequence according to an embodiment of the present invention. In the same manner as in FIG. 4, the printing is advanced in order of pages 2, 4, 1, 5, and 3. Even if it takes a large amount of time to process the data for page 8, the printing process for page 6 that is the last printing side opposite to page 5 is not executed, and the paper sheet corresponding to pages 5 and 6 stands by inside the reversing mechanism unit 31. Then, when the data processing for page 8 is completed and the bitmap data is generated, the printing is continued again by the high-speed double-sided printing control in order of pages 8, 6, 10, 7, 12, 9, and 11. In this printing process, the switch is not made from the high-speed double-sided printing control to the normal double-sided printing control. As a result, the time for the entire printing process becomes shorter than the case of FIG. 4 described above.

Figure 6:
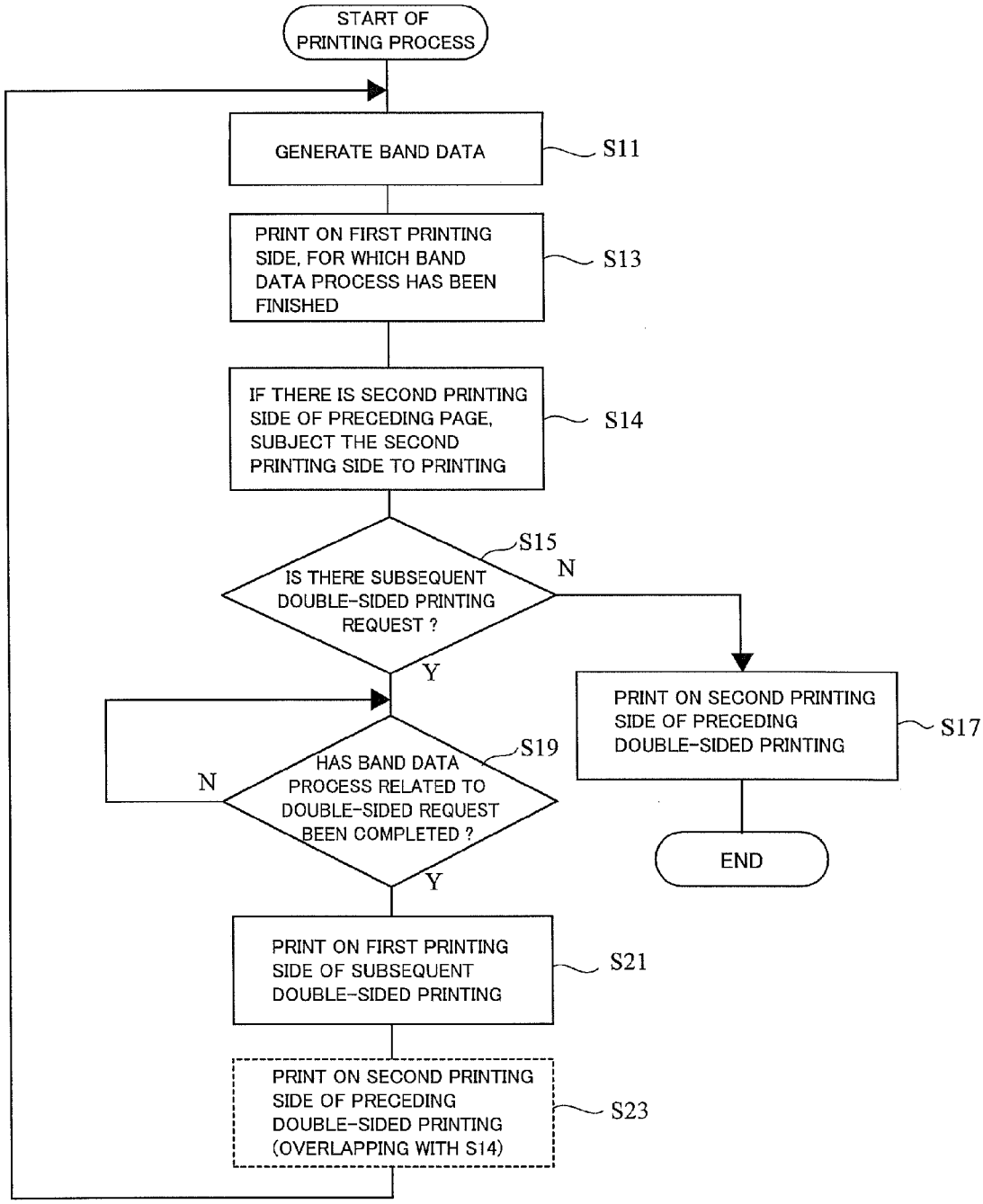
FIG. 6 is a flowchart of an operation performed by the printing apparatus according to an embodiment of the present invention.

The flowchart of FIG. 6 is used to further describe the printing sequence described by referring to FIG. 5.

S11: Image processing for print data is performed to generate band data (bitmap data) that can be printed by the printing unit 12.

S13: Printing is performed on the first printing side of the double-sided printing, for which a generation process for the band data (bitmap data) has been completed (which corresponds to page 5 of FIG. 5).

S14: If there is a last printing side of the paper sheet preceding the paper sheet on which the printing has been performed in Step S13, the last printing side is subjected to printing (which corresponds to page 3 of FIG. 5). For example, the printing is not performed if the printing performed in Step S11 is printing on a leading paper sheet because there is no page preceding the leading paper sheet.

S15: It is determined whether or not there is a subsequent double-sided printing request. If there is a subsequent double-sided printing request, the operation advances to Step S19. If there is not a subsequent double-sided printing request, the operation advances to Step S17. In the example of FIG. 5, there is the double-sided printing with the front side being page 7 and the back side being page 8, and hence operation would advance to Step S19.

S17: If there is no subsequent printing paper sheet, as in a case of the last page of the last copy, the printing on the last printing side of the preceding double-sided printing is performed to finish the printing operation.

S19: As a result of the determination of Step S15, there is a subsequent double-sided printing request, and hence the operation is caused to delay until the generation process for the band data (bitmap data) is completed. Once the data is generated, the operation is advanced to Step S21.

S21: The generation of the band data (bitmap data) is completed, and hence printing on the first printing side of the double-sided printing of the paper sheet for the band data (which corresponds to page 8 in the example of FIG. 5) is performed.

S23: Printing on the last printing side of the preceding double-sided printing is performed (which corresponds to page 6 of in the example of FIG. 5). After that, the operation returns to S11 to repeat the same processes. Step S23 and Step S14 may overlap each other.

According to the printing apparatus and the printing method of an embodiment of the present invention, it becomes possible to prevent such a situation that the high-speed double-sided printing control cannot be continued due to a delay or the like in data processing and the entire printing time becomes too long as a result.

The description of embodiments of the present invention is directed to the case where the process is delayed when one copy of a document having an even number of pages is printed in the double-sided printing, but the present invention is not limited thereto. For example, the present invention can be applied to any one of: a case where data is not provided in time at a pause between copies while printing a plurality of copies; a case where a document having an odd number of pages is printed by using the back side of a dummy as in the example of FIG. 3A; and a case where the document having an odd number of pages is printed without using the back side of a dummy as in the examples of FIGS. 3B, 3C, and 3D.

While the description of the printing control in FIGS. 3A to 3D, FIG. 4 and FIG. 5 is directed to a method of printing from the back side of the double-sided printing, but the present invention can be similarly implemented also in a case of printing from the front side of the double-sided printing. Further, although described is the example of printing in order from the first page, the present invention can be similarly implemented in a case of performing printing from the second page.

Further, although described is the printing control in FIGS. 3A to 3D, FIG. 4 and FIG. 5 including a parallel process performed on two paper sheets, the parallel process may be performed on three paper sheets or more. The parallel process performed on three paper sheets means a method of printing on the first printing sides of subsequent paper sheets between the printing on the first printing side of the first paper sheet and the printing on the second printing side thereof. The printing on the first printing sides of the three paper sheets including the first paper sheet is processed before finishing the process of the first paper sheet.

The above-mentioned embodiment constitutes a preferred example of the present invention, but the present invention is not limited thereto, and various modifications and changes can be made within the scope of the present invention without departing from the spirit of the present invention.

What is claimed is:

1. A printing apparatus, comprising:

a job receiving unit that receives a printing job;

a printing unit that performs printing on a paper sheet based at least in part on the printing job;

a reversing mechanism unit that reverses the paper sheet for which printing on a first printing side has been finished by the printing unit and transports the paper sheet again to the printing unit in order for printing to be performed on a second printing side thereof;

a printing control unit that executes double-sided printing control of the printing job received by the job receiving unit by performing, between printing on the first printing side of the paper sheet and printing on the second printing side thereof, printing on the first printing side of a next paper sheet;

a determination unit that determines, before printing on the next paper sheet, that there is a request to print on the next paper sheet and whether processing of print data for the next paper sheet has been completed; and a standby control unit that causes the printing unit to delay a printing process on the second printing side of the paper sheet until printing on the first printing side of the next paper sheet is finished if it is determined by the determination unit that the processing of print data for the next paper sheet has not been completed.

2. The printing apparatus according to claim 1, wherein the printing job comprises a printing job for a document having a plurality of pages.

3. The printing apparatus according to claim 1, wherein the printing job comprises a printing job for a plurality of copies of a document having a plurality of pages.

4. The printing apparatus according to claim 1, wherein the printing control unit executes the double-sided printing control to perform printing based on a plurality of printing jobs continuously received by the job receiving unit.

5. The printing apparatus according to claim 1, wherein the printing control unit executes the double-sided printing control while the standby control unit causes the printing unit to delay the printing process on the second printing side of the paper sheet.

6. The printing apparatus according to claim 1, wherein the determination unit performs the determining while the printing control unit is executing the double-sided printing control.

7. The printing apparatus according to claim 1, wherein the standby control unit causes the paper sheet to be delayed inside the reversing mechanism unit.

8. The printing apparatus according to claim 1, wherein the processing of print data comprises a process of creating bitmap data that can be printed by the printing unit.

9. A printing apparatus, comprising:

a job receiving unit that receives a printing job;

a printing unit that performs printing on a paper sheet based at least in part on the printing job;

a reversing mechanism unit that reverses the paper sheet for which printing on a first printing side has been finished by the printing unit and transports the paper sheet again to the printing unit in order for printing to be performed on a second printing side thereof;

a printing control unit that executes double-sided printing control of the printing job received by the job receiving unit by performing, between printing on the first printing side of the paper sheet and printing on the second printing side thereof, printing on the first printing side of a next paper sheet;

a determination unit that determines, when printing on the second printing side of a paper sheet preceding the paper sheet is finished and after the printing on the first printing side of the paper sheet, that there is a request to print the next paper sheet and whether processing of print data for the next paper sheet has been completed; and a standby control unit that causes the printing unit to delay a printing process on the second printing side of the paper sheet until printing on the first printing side of the next paper sheet is finished if it is determined by the determination unit that the processing of print data for the next paper sheet has not been completed.

10. The printing apparatus according to claim 9, wherein the printing job comprises a printing job for a document having a plurality of pages.

11. The printing apparatus according to claim 9, wherein the printing job comprises a printing job for a plurality of copies of a document having a plurality of pages.

12. The printing apparatus according to claim 9, wherein the printing control unit executes the double-sided printing control to perform printing based on a plurality of printing jobs continuously received by the job receiving unit.

13. The printing apparatus according to claim 9, wherein the printing control unit executes the double-sided printing control while the standby control unit causes the printing unit to delay the printing process on the second printing side of the paper sheet.

14. The printing apparatus according to claim 9, wherein the determination unit performs the determining while the printing control unit is executing the double-sided printing control.

15. The printing apparatus according to claim 9, wherein the standby control unit causes the paper sheet to be delayed inside the reversing mechanism unit.

16. The printing apparatus according to claim 9, wherein the processing of print data comprises a process of creating bitmap data that can be printed by the printing unit.

17. A printing method for a print controller on a printing apparatus, comprising:

the print controller causing the printing apparatus to receive a printing job;

the print controller causing the printing apparatus to print on a paper sheet based at least in part on the printing job;

the print controller causing the printing apparatus to reverse the paper sheet for which printing on a first printing side has been finished and to transport the paper sheet to a print unit in order for printing to be performed on a second printing side thereof;

the print controller causing the printing apparatus to execute double-sided printing control of the printing job by performing, between the printing for the first printing side of the paper sheet and the printing for the second printing side thereof, printing for the first printing side of a next paper sheet;

the print controller causing the printing apparatus to determine, prior to printing on the next paper sheet, that there is a request to print on the next paper sheet and whether processing of print data for the next paper sheet has been completed; and the print controller causing the printing apparatus to delay execution of the printing for the second printing side of the paper sheet until the printing for the first printing side of the next paper sheet is finished if it is determined that the processing of print data for the next paper sheet has not been completed.

18. The method of claim 17, wherein the printing job comprises a printing job for a plurality of copies of a document having a plurality of pages.

19. The method of claim 17, wherein the print controller causes the printing apparatus to make the determining while causing the printing apparatus to execute double-sided printing control.

20. The method of claim 17, further comprising the print controller causing the printing apparatus to delay the paper sheet inside a reversing mechanism unit.

* * * * *